US006263890B1

(12) United States Patent
Höser

(10) Patent No.: US 6,263,890 B1
(45) Date of Patent: Jul. 24, 2001

(54) CLEANING DEVICE FOR A DRY SHAVER

(75) Inventor: Jürgen Höser, Neu Anspach (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/341,930

(22) PCT Filed: Jan. 24, 1998

(86) PCT No.: PCT/EP98/00404

§ 371 Date: Jul. 21, 1999

§ 102(e) Date: Jul. 21, 1999

(87) PCT Pub. No.: WO98/35580

PCT Pub. Date: Aug. 20, 1998

(30) Foreign Application Priority Data

Feb. 17, 1997 (DE) ..... 197 05 977

(51) Int. Cl.[7] ..... B08B 3/04
(52) U.S. Cl. ..... 134/111; 134/186; 134/201
(58) Field of Search ..... 134/111, 186, 134/201

(56) References Cited

U.S. PATENT DOCUMENTS 5,649,557 * 7/1997 Usher ..... 134/111 X
5,711,328 * 1/1998 Braun ..... 134/111

FOREIGN PATENT DOCUMENTS 44 02 238 7/1995 (DE) .
2 568 111 7/1984 (FR) .
96/18463 6/1996 (WO) .

* cited by examiner

*Primary Examiner*—Philip R. Coe
(74) *Attorney, Agent, or Firm*—Fish & Richardson P.C.

(57) ABSTRACT

The invention is directed to a cleaning device (RV) for cleaning a shaving head (SK) of a dry shaving apparatus (TR), having a housing (1), a holding device (2), a cleaning liquid container (3), a filter (4), a feed device (6) adapted to be driven by a motor (5) and including a supply pipe (7) leading to a cleaning basin (8) and a liquid drain (9) from the cleaning basin (8) to the cleaning liquid container (3), wherein the cleaning liquid container (3) with integrated filter (4) is adapted to be coupled with a wall (12) of the housing (1) by means of a latching device (V).

12 Claims, 4 Drawing Sheets

CLEANING DEVICE FOR A DRY SHAVER

BACKGROUND OF THE INVENTION

This invention relates to a cleaning device for cleaning a shaving head of a dry shaving apparatus, having a housing, a holding device, a cleaning liquid container, a filter, a feed device adapted to be driven by a motor and including a supply pipe leading to a cleaning basin and a liquid drain from the cleaning basin to the cleaning liquid container.

A cleaning device of the type initially referred to is known from DE 44 02 238 C2. In one embodiment of a cleaning device according to that printed specification—FIG. 1—, a cleaning basin is provided with a connector having fitted thereto a porous hose member permeable to cleaning liquid to ensure that dirt particles do not enter the cleaning liquid container. Due to the substantial amounts of dirt particles needing to be removed from the shaving head of a dry shaving apparatus, the hose member is fouled in no time, which prevents cleaning liquid drained from the cleaning basin during the cleaning process from entering the cleaning liquid container. This results in spillage of cleaning liquid from the cleaning device. Approaches aimed at remedying the fouled condition, including in particular the removal of dirt particles, cannot be inferred from this printed specification.

In another embodiment of a cleaning device according to DE 44 02 238 C2—FIG. 6—provision is made for a cleaning liquid container with integrated filter provided in the cleaning liquid circuit between the feed device and the cleaning basin, wherein the cleaning liquid, together with the dirt particles occurring in the respective cleaning operation, is fed by the feed device from the collecting reservoir associated with the cleaning basin directly to the inner chamber of a filter, being retained by this filter. At the beginning of the cleaning operation the feed pump of the cleaning device initially aspirates air, forcing the air through the cleaning liquid container with integrated filter until the cleaning liquid present in the cleaning liquid container reaches the cleaning basin through a conduit and subsequently, through the collecting reservoir, the intake pipe of the feed pump. The continuous accumulation of dirt particles in the inner chamber of the filter presents an increasing resistance in the fluid circuit from the feed device to the cleaning basin, with the result that a feed device having a higher load-carrying capacity and hence incurring greater expense needs to be provided.

It is an object of the present invention to provide a cleaning device of the type initially referred to, which ensures easy exchangeability of the cleaning liquid container and a secure positioning of the cleaning liquid container in the cleaning liquid circuit.

SUMMARY OF THE INVENTION

According to the present invention, this object is accomplished in a cleaning device of the type initially referred to in that the cleaning liquid container with integrated filter is adapted to be coupled with a wall of the housing by means of a latching device. A further solution to the above-mentioned object provides for the cleaning liquid container with an integrated filter to be arranged underneath the cleaning basin, for the feed device to be adapted to be coupled with the inner chamber of the filter, for a backflow of cleaning liquid to be possible from the supply pipe through the filter into the cleaning liquid container, and for the cleaning liquid container to be removably held in the housing by means of a latching device.

The cleaning device of the present invention affords several advantages. One significant advantage of the invention is that the latching device, which is adapted to couple the exchangeable cleaning liquid container with a wall of the housing, operates to ensure both a locally defined and a secure arrangement of the cleaning liquid container in the cleaning device. A cleaning liquid container with integrated filter containing, for example, dirt particles is readily removable from the housing simply by actuating the latching device, to be replaced by a new cleaning liquid container holding fresh, pure liquid, which container is then held locked in its proper position in the cleaning liquid circuit within the housing of the cleaning device by the latching device.

A further advantage of the present invention resides in that a fluid circuit optimal in its effect is accomplished by reason of the latchable arrangement of the exchangeable cleaning liquid container with integrated filter underneath the cleaning basin and the subsequent connection of the feed device with the inner chamber of the filter on the one hand and, on the other hand, the further supply of the purified liquid through a supply pipe to the cleaning basin, as well as due to the draining of the cleaning liquid from the cleaning basin into the cleaning liquid container. This fluid circuit ensures that the aggregate of the cleaning liquid is drained from the cleaning basin to the cleaning liquid container and, moreover, that the cleaning liquid present in the supply pipe returns to the cleaning liquid container through the feed device and the filter upon termination of the cleaning operation, that is, upon deactivation of the feed device.

In a preferred embodiment of the present invention provision is made for the cleaning liquid container to be held in a proper position in the fluid circuit between the cleaning basin and the feed device by means of the latching device.

In a further aspect of the present invention, provision is made for the cleaning liquid container to be arranged underneath the cleaning basin and to be latchable with the wall of the housing, it being ensured that the liquid is drained through a drain in the cleaning basin to reach a supply to the cleaning liquid container by means of cooperating components of the latching device.

According to an embodiment of the present invention, the latching device is formed of a detent device and a spring element. In a further aspect of this embodiment, the detent device is formed of a guideway having a latching position and a control element movable for engagement with the guideway. Preferably the control element is formed by a pivotal lever having a control cam.

A preferred embodiment of the present invention is characterized in that the guideway essentially follows the contour of a heart having a lead-in path to a latching position. A simple embodiment of an exchangeable cleaning liquid container affording economy of manufacture results by providing the guideway in an outer side of a wall of the cleaning liquid container.

According to a low-cost embodiment of the present invention, the control element is mounted for pivotal movement on the wall of the housing.

In a particularly advantageous embodiment of the present invention provision is made for a recess in the wall of the housing for the pivotal arrangement of the control element, with the control cam being disposed on the control element so as to protrude from the recess.

Proper positioning and secure mounting of the cleaning liquid container in the cleaning device are characterized in that the cleaning liquid container is slidable into, and retained in, a latching position against the pressure of a spring element resting against an abutment.

In a preferred embodiment of the present invention the abutment is formed by a wall of the housing.

To facilitate the positioning as well as the withdrawal of the exchangeable cleaning liquid container in the housing of the cleaning device, a pressure transmitting element is provided between the spring element and the cleaning liquid container. In a further aspect of the present invention at least one locating element for the spring element is provided on the pressure transmitting element. This approach simplifies and facilitates the insertion and removal of the cleaning liquid container inside the cleaning device. To simplify the coupling of the cleaning liquid container with the feed device, a pipe provided on the feed device is adapted to be passed through an opening in the pressure transmitting element and coupled with the filter at a position midway along the relative distance of the locating elements. In addition the pressure transmitting element serves to protect the pipe.

Further advantages and details of the present invention will become apparent from the subsequent description and the accompanying drawings illustrating a preferred embodiment. In the drawings showing the cleaning liquid container removed and the operation of coupling the cleaning liquid container with the pipe.

DETAILED DESCRIPTION

Figure 1:
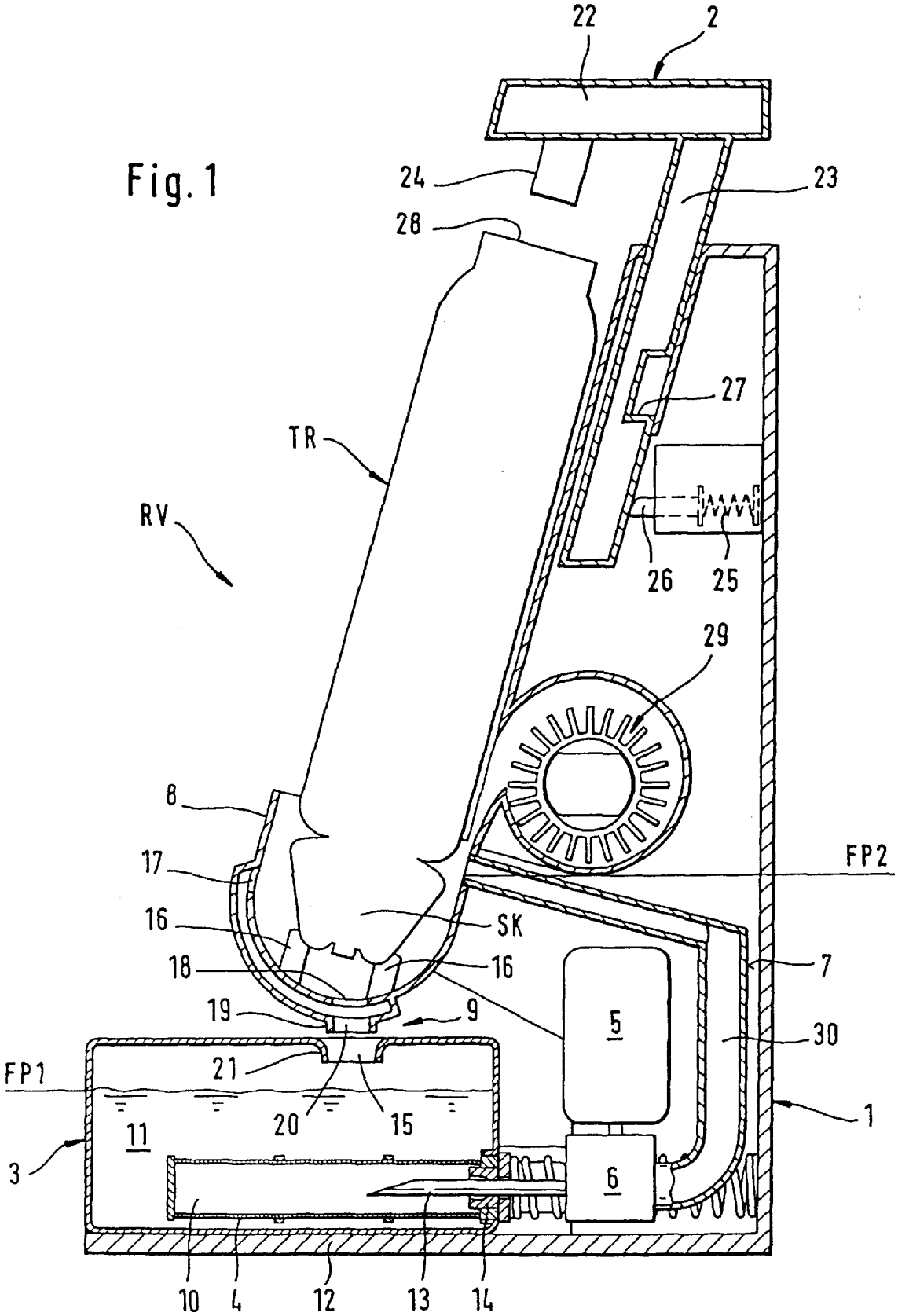
FIG. 1 is a longitudinal sectional view of a cleaning device, comprising a cleaning liquid container with integrated filter underneath a cleaning basin, a feed device, and a supply pipe to the cleaning basin carrying the shaving head of a dry shaving apparatus.

FIG. 1 shows a cleaning device RV for cleaning a shaving head SK of a dry shaving apparatus TR, comprising a housing 1, a holding device 2, a cleaning liquid container 3, a filter 4, a feed device 6 adapted to be driven by a motor 5 and having a supply pipe 7 leading to a cleaning basin 8, and a liquid drain 9 from the cleaning basin 8 to the cleaning liquid container 3.

The cleaning liquid container 3 with an integrated filter 4 is arranged underneath the cleaning basin 8 and above a wall 12 of the housing 1. The feed device 6 is in fluid communication with the inner chamber 10 of the filter 4 through a pipe 13. To establish a liquid-tight coupling between the pipe 13 and the filter 4, a seal 14 is disposed in a wall of the filter 4, the sealing properties of said seal being selected such that the requisite sealing effect is ensured not only with the pipe 13 inserted but also when the cleaning liquid container 3 with integrated filter 4 is subsequently uncoupled from the pipe 13.

The inner curvature of the cleaning basin 8 conforms approximately to the outer contour of a shaving head SK of a dry shaving apparatus TR, holding only as much cleaning liquid as is necessary for the particular cleaning operation. To support the shaving head SK, provision may be made, for example, for two supporting elements 16 made of an elastic material on the bottom of the cleaning basin 8. The cleaning basin 8 includes an overflow device 17 to prevent the cleaning liquid 11 from exceeding a defined level in the cleaning basin 8, thus ensuring that only the shaving head SK or part of the shaving head SK is immersed in cleaning liquid 11 when the cleaning device RV is in operation. In this embodiment the liquid drain 9 from the cleaning basin 8 to the cleaning liquid container 3 is formed by an outlet port 18 in the cleaning basin 8, with the outlet port's area of cross section being also adapted to control the level of the cleaning liquid in the cleaning basin, by a further outlet port 20 configured as a connector 19, and by an inlet port 15 configured, for example, as a funnel 21 in the cleaning liquid container 3. For handling the exchangeable cleaning liquid container 3, for example, the inlet port 15 is closable with a cover—not shown.

The dry shaving apparatus TR rests on the supporting elements 16 in the cleaning basin 8 where it is held by means of an adjustable holding device 2. The holding device 2 is formed essentially by a wall 23 extending parallel to a wide dimension of the dry shaving apparatus TR, and by a wall 22 associated with the bottom wall of the dry shaving apparatus TR. Provided on the wall 22 is a retaining element 24 configured as a coupler plug. The wall 23 of the holding device 2 coupled with the wall 22 is slidably mounted in the housing 1, for example, parallel to the wide dimension of the housing of the dry shaving apparatus TR, in such manner that a displacement of the holding device 2 in the direction of the cleaning basin 8 ensures coupling of the retaining element 24 configured as coupler plug with the coupler socket 28 of the dry shaving apparatus TR, while a displacement of the holding device 2 in the opposite direction ensures uncoupling of the holding device 2 from the dry shaving apparatus TR. Coupling the plug of the retaining element 24 with the socket ensures, through the connection to the electric circuit provided in the cleaning device for operating the feed device and/or fan device, an electric voltage supply for various purposes including, for example, an activation of the electric drive mechanism of the dry shaving apparatus TR by hand or under automatic control when the cleaning device RV is set in operation, and/or a recharging operation of a dry shaving apparatus TR equipped with a rechargeable storage cell following deactivation of the cleaning device RV. Operation of the dry shaving apparatus during the cleaning cycle supports the cleaning action of the cleaning liquid 11 due to the oscillating motion of a cutting element provided in the shaving head of the dry shaving apparatus and the attendant swirl of the cleaning liquid 11 in the shaving head.

The cleaning device of FIG. 1 makes provision for a fan device 29 supplying air for drying the shaving head SK upon completion of the cleaning cycle, that is, after all of the cleaning liquid 11 is drained from the cleaning basin 8. Activation and deactivation of the fan device 29 may be part of a switching program of a programmable switching device—not shown—and/or controllable separately by hand.

Provided in the housing 1 is a latching device which is formed by a spring element 25, a detent element 26 and a notch 27. The notch 27 is disposed in the wall 23 of the holding device 2 in such manner that in the course of the displacement of the holding device 2 for holding the dry shaving apparatus TR in a position suitable for cleaning the shaving head SK the detent element 26 acted upon by the spring element 25 engages with the notch 27, arresting the holding device 2 with the dry shaving apparatus TR in this position.

In the embodiment of FIG. 1 the cleaning liquid 11 is fed by the feed device 6 through a supply pipe 7 to the cleaning basin 8 disposed above the cleaning liquid container 3. The supply pipe 7 is configured as a riser 30 whose liquid level FP2 is determined by the mouth of the riser opening into the cleaning basin 8. The level difference between FP2 and the level FP1 of the cleaning liquid 11 in the cleaning liquid container 3 is selected such that following deactivation of the feed device 6 the ensuing backflow of cleaning liquid 11 through the feed device 6 and the filter 4 causes dirt particles adhering to the outer wall of the filter 4 to be dislodged from the filter wall and urged into the cleaning liquid container 3.

Figure 2:
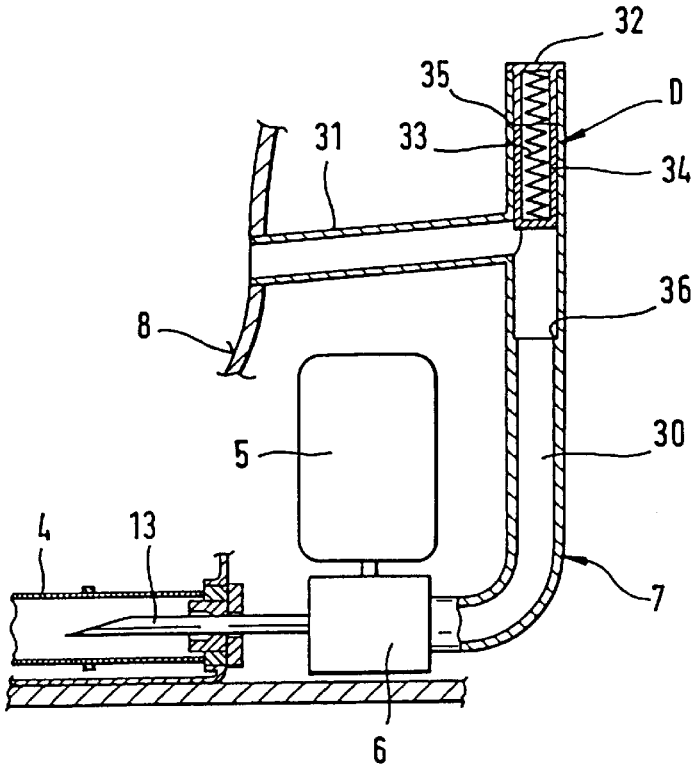
FIG. 2 is a view of a motor-driven feed device having one end thereof coupled with a filter through a pipe while its other end is coupled with a cleaning basin through a supply pipe with built-in pressure accumulator.

FIG. 2 shows a further embodiment of a supply pipe 7 leading from the feed device 6 to the cleaning basin 8. The supply pipe 7 is subdivided into a riser 30 and a downpipe 31. In the area of the branch of the downpipe 31 from the riser 30 to the cleaning basin 8, the riser 30 accommodates a pressure accumulator D comprising a cylinder piston 34 displaceable against a spring element 33. The end of the spring element 33 remote from the cylinder piston 34 bears against the cover 32 providing a liquid-tight seal for the riser 30. An annular wall of the cover 32 extends into the riser 30, forming, for example, a stop 35 for the cylinder piston 34 to limit the piston stroke in the riser 30. A further stop 36 limiting the stroke of the cylinder piston 34 in opposition to the direction of flow of the cleaning liquid 11 is formed, for example, by a reduced enlargement of the inside diameter of the riser 30 in the area of the junction with the downpipe 31.

Activation of the feed device 6 causes cleaning liquid 11 to be aspirated from the cleaning liquid container 3 through the filter 4 and to be conveyed in the riser 30 of the supply pipe 7 in the direction of the pressure accumulator D. The feed pressure of the cleaning liquid 11 moves the cylinder piston 34 against the pressure of the spring element 33, displacing the cylinder piston in the direction of the stop 35. As this displacement occurs, the cylinder piston 34 releases the opening of the downpipe 31 leading to the cleaning basin 8, enabling the cleaning of a shaving head SK of a dry shaving apparatus TR held in the cleaning basin 8. Upon deactivation of the feed device 6 and the attendant drop in the feed pressure of the cleaning liquid 11, the cylinder piston 34 of the pressure accumulator D acts on the cleaning liquid 11 by means of the energy stored in the spring element 33, forcing the cleaning liquid 11 through the feed device 6 and the pipe 13 into the inner chamber 10 of the filter 4 and onward through the filter wall back into the cleaning liquid container 3. The volume and pressure magnitudes of this backflow of cleaning liquid 11 effected by the pressure accumulator D are selected such that dirt particles adhering to the outer wall of the filter 4 are dislodged therefrom and moved into the inner chamber of the cleaning liquid container 3. In contrast to the embodiment of FIG. 1, the arrangement of a pressure accumulator D in a supply pipe 7 leading from a feed device 6 to a cleaning basin 8 represents an alternative embodiment for freeing the outer wall of a filter 4 of dirt particles by the backflow of the cleaning liquid 11.

Figure 3:
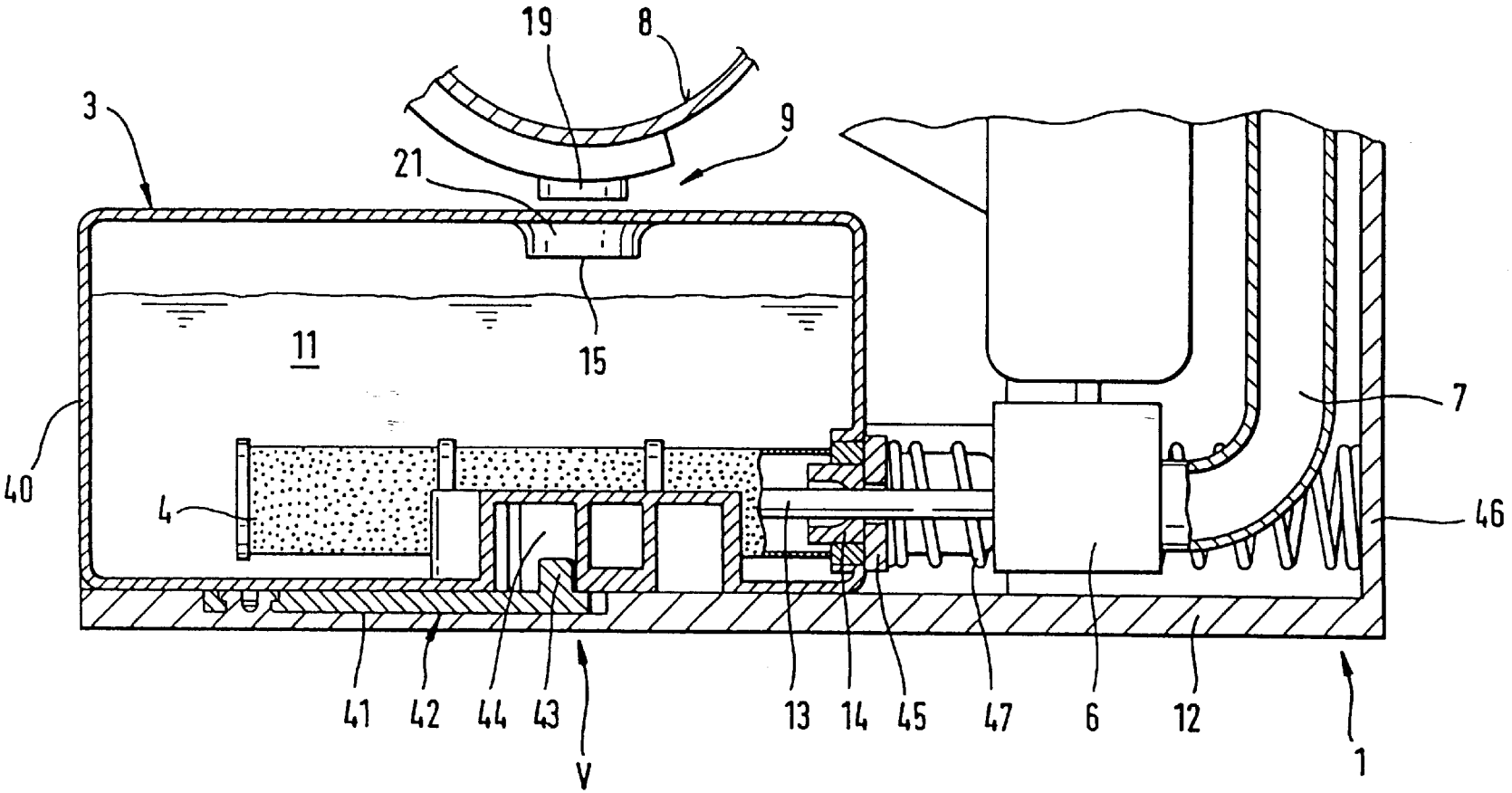
FIG. 3 is a sectional view of the lower part of a cleaning device, in particular of a cleaning liquid container with integrated filter and a latching device coupling a wall of the housing with the cleaning liquid container, and of a feed device with the supply pipe connected thereto.

FIG. 3 shows details of a proper positioning of a cleaning liquid container 3 with integrated filter 4 in the housing 1 of the cleaning device RV. Provided in a wall 12 forming the bottom of the housing 1 is a recess 41 receiving pivotally therein a control element 42 having a control cam 43 protruding from the recess 41. The control cam 43 is in engagement with a guideway 44 provided on the outside of a wall 40 of the cleaning liquid container 3. The latching device V maintains the cleaning liquid container 3 in a latched position provided in the guideway 44 using, for example, the effect of the pressure of a spring element 47 resting with one end against an abutment 46 provided on the housing 1 while its other end bears against a pressure transmitting element 45 resting against the wall 40 of the cleaning liquid container 3. A pipe 13 passing through the seal 14 connects the inner chamber of the filter 4 with the feed device 6 delivering the cleaning liquid 11 through the supply pipe 7 to the cleaning basin 8. With the cleaning liquid container 3 latched with the wall 12 of the housing 1 as shown, the inlet port 15 configured as a funnel 21 is located underneath the connector 19 provided on the outlet port 20 of the overflow device 17 of the cleaning basin 8, whereby the fluid circuit is established from the cleaning liquid container 3 through the filter 4, the pipe 13, the spring elements, the supply pipe 7 to the cleaning basin 8.

Details of the structure of the latching device V are illustrated in the sectional view of FIG. 4 and will be described in more detail in the following.

Figure 4:
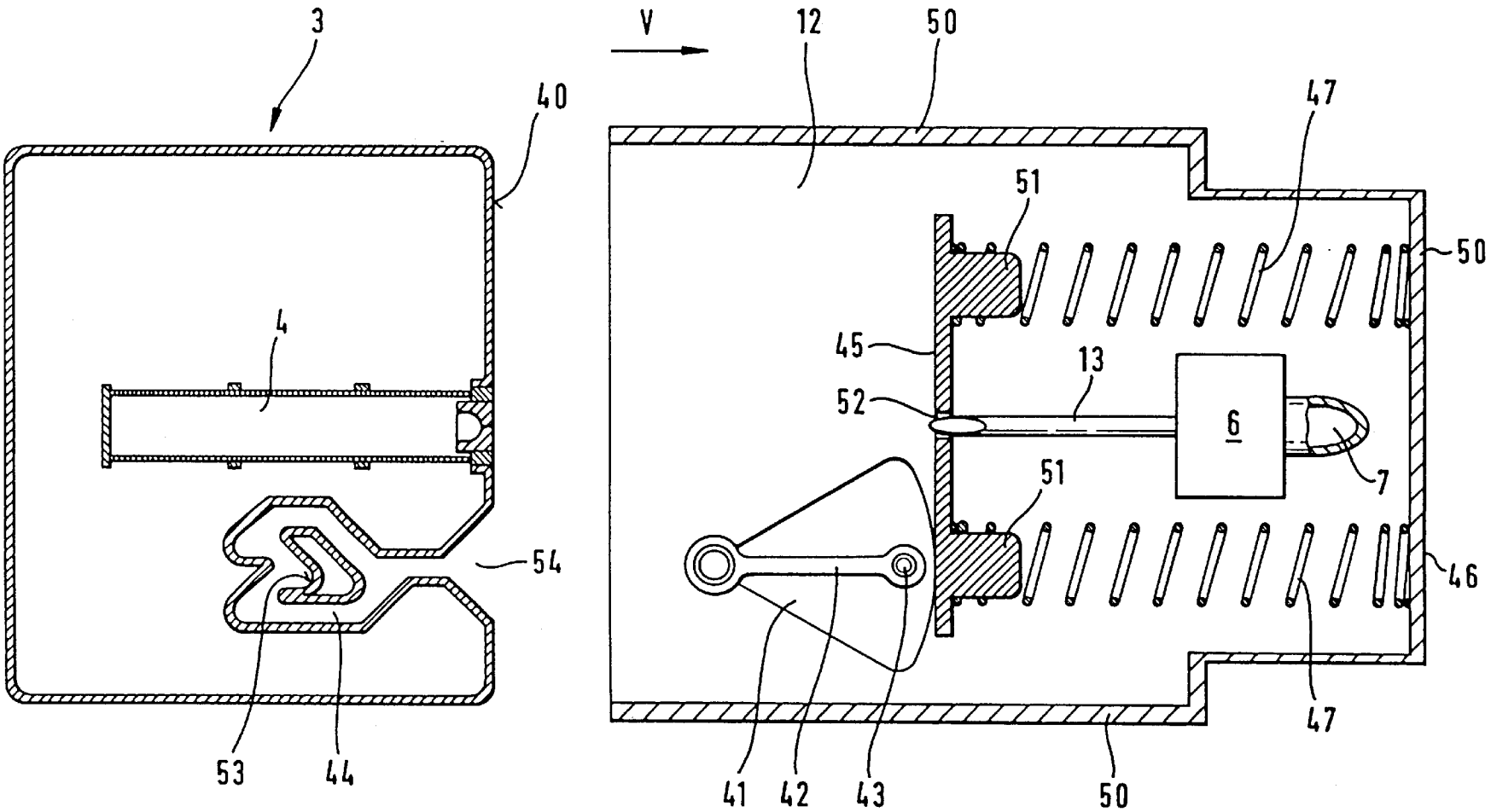
FIG. 4 is a sectional view of the lower part of the housing of the cleaning device, showing a pressure transmitting element acted upon by spring elements, and a control element with a control cam for coupling the cleaning liquid container, shown adjacent thereto in section and having a guideway and a lead-in path.

FIG. 4 shows a section through several side walls 50 of the housing 1 so that the wall 12 representing the bottom of the housing 1 is visible. Formed into the wall 12 is a recess 41 receiving pivotally therein a control element 42 configured as a one-armed lever having a control cam 43 integrally formed thereon. This embodiment further shows a pressure transmitting element 45 having locating elements 51 integrally formed thereon for guiding spring elements 47 which bear against an abutment 46 formed by a side wall 50 of the housing 1. Shown between the two spring elements 47 extending in spaced relation parallel to each other is the feed device 6 with a plug-in tube 13. With the spring elements 47 in released condition, the plug-in tube 13 projects into an opening 52 provided in the pressure transmitting element 45, and it is adapted to be coupled with the filter 4 disposed in the cleaning liquid container 3 on displacement of the pressure transmitting element 45.

FIG. 4 further shows a section through the wall 40 of the cleaning liquid container 3 with built-in filter 4, illustrating also the path of the guideway 44 from a lead-in path 54 open from an outside to a latching position 53. The guideway 44 has essentially the contour of a heart in which the lead-in path 54 is directed at an outer tip of the heart, while the latching position 53 is formed by the inner lying tip of the heart.

For the purpose of coupling the cleaning liquid container 3 with the housing 1, the cleaning liquid container 3 is inserted between the two parallel side walls 50 of the housing 1. As this movement proceeds, the control cam 43 of the control element 42 projecting from the recess 41 engages with the lead-in path 54, continuing its course along the guideway 44 until it reaches the latching position 53. As the control cam 43 enters the lead-in path 54, the wall 40 of the cleaning liquid container 3 engages the pressure transmitting element 45, moving it against the pressure of the spring elements 47 in the direction of the arrow V until the control cam 43 has reached the latching position 53. On completion of the displacement of the cleaning liquid container 3 in the direction of the arrow V, the cleaning liquid container 3, under the action of the spring tension of the spring elements 47, is urged against the control cam 43 and held in the latching position 53.

By exerting again pressure on the cleaning liquid container 3 in the direction of the arrow V, the control cam 43 with the control element 42 is disengaged from the latching position 53 in the guideway 44, performing a controlled movement along the guideway 44 to the lead-in path 54, so that the cleaning liquid container 3 can be removed from the housing 1.

Figure 5:
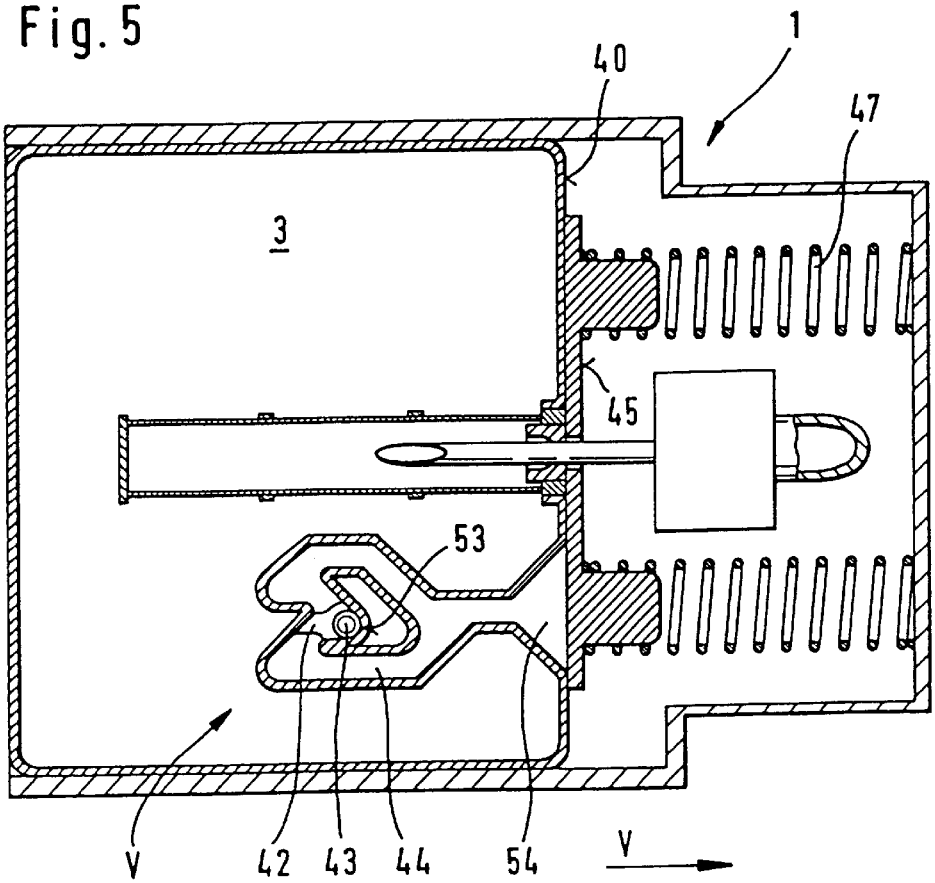
FIG. 5 is a view of the lower part of the housing and the cleaning liquid container of FIG. 4 in latched condition.

FIG. 5 shows a section through the housing 1 and the cleaning liquid container 3 of the cleaning device RV, including a sectional representation of a latching device V shown in latched condition. The control cam 43 integrally formed on the control element 42 is engaged in the latching position 53 provided in the guideway 44, being held in this latching position 53 under the action of the spring elements 47 acting through the pressure transmitting element 45 on the wall 40 of the cleaning liquid container 3. When a displacement pressure is exerted on the cleaning liquid container 3 against the pressure of the spring elements 47, the control cam is disengaged from the latching position 53, sliding along the guideway 44 to the lead-in path 54 so that in this unlatched position the cleaning liquid container 3 can be removed from the housing 1.

What is claimed is:

1. A cleaning device for cleaning a shaving head of a dry shaving apparatus by circulation of a cleaning liquid, the cleaning device comprising:

a housing comprising at least a first wall;

a holding device attached to the housing for holding the shaving apparatus to be cleaned;

a cleaning liquid container for containing the cleaning liquid, the cleaning liquid container being removably attached to the housing and having an integrated filter;

a feed device associated with the housing for delivering the cleaning liquid between the cleaning liquid container and the shaving head to be cleaned, the feed device adapted to be driven by a motor and including a supply pipe, a cleaning basin for receiving the shaving head to be cleaned, and a liquid drain, the supply pipe leading to the cleaning basin, the liquid drain allowing cleaning liquid transfer from the cleaning basin to the cleaning liquid container; and a latching device associated with the housing and the cleaning liquid container, wherein the cleaning liquid container with integrated filter is adapted to be coupled with the first wall of the housing by the latching device.

2. The cleaning device according to claim 1, wherein the cleaning liquid container with the integrated filter is arranged underneath the cleaning basin, the integrated filter includes an inner chamber, the feed device is adapted to be coupled with the inner chamber of the integrated filter so that a backflow of a portion of the cleaning liquid within the fluid circuit occurs from the supply pipe through the integrated filter into the cleaning liquid container, and wherein the cleaning liquid container is removably held in the housing by means of the latching device.

3. The cleaning device as claimed in claim 2, wherein the cleaning liquid container, the feed device and the cleaning basin together form a fluid circuit, the cleaning liquid container being held in a proper position in the fluid circuit between the cleaning basin and the feed device by the latching device.

4. The cleaning device as claimed in claim 3, wherein the latching device comprises cooperating components and the cleaning basin comprises an inlet port, the cleaning liquid container being arranged underneath the cleaning basin and latchable with the first wall of the housing by the cooperating components of the latching device in a manner ensuring that the cleaning liquid being circulated by the cleaning device is drained through the liquid drain from the cleaning basin to reach the inlet port of the cleaning liquid container by the cooperating components of the latching device.

5. The cleaning device as claimed in claim 4, wherein the latching device comprises a detent device and a spring element.

6. The cleaning device as claimed in claim 5, wherein the detent device comprises a guideway having a latching position and a control element, the control element being movable for engagement with the guideway.

7. The cleaning device as claimed in claim 6, wherein the control element is formed by a pivotal lever having a control cam.

8. The cleaning device as claimed in claim 6, wherein the guideway essentially follows a contour of a heart-shape having a lead-in path to the latching position.

9. The cleaning device as claimed in claim 6, wherein the guideway is provided in an outer side of a wall of the cleaning liquid container.

10. The cleaning device as claimed in claim 6, wherein the control element is mounted for pivotal movement on the first wall of the housing.

11. The cleaning device as claimed in claim 10, wherein a recess is provided in the first wall of the housing for the pivotal movement of the control element, with the control cam being disposed on the control element so as to protrude from the recess.

12. The cleaning device as claimed in claim 11, further comprising at least one spring element, the housing further including an abutment, wherein the cleaning liquid container is slidable into, and retained in, the latching position against the pressure of the at least one spring element, the at least one spring element resting against the abutment.

* * * * *